US005853182A

United States Patent [19]

Finkle

[11] Patent Number: 5,853,182

[45] Date of Patent: Dec. 29, 1998

[54] TRUCK ASSEMBLY FOR SKATEBOARDS

[76] Inventor: Louis J. Finkle, 3300 E. 59th St., Long Beach, Calif. 90805

[21] Appl. No.: 800,091

[22] Filed: Feb. 12, 1997

[51] Int. Cl.[6] ..... B62M 1/00

[52] U.S. Cl. ..... 280/87.042; 280/11.27; 403/117

[58] Field of Search ..... 280/87.042, 87.041, 280/11.27, 11.28; 403/112, 113, 116, 117; 16/18 K, 18 A, 43–45

[56] References Cited

U.S. PATENT DOCUMENTS 2,763,490 9/1956 Crone ..... 280/11.28

4,047,725 9/1977 Pinchock ..... 280/11.28

4,071,256 1/1978 Kimmell ..... 280/11.28

*Primary Examiner*—Robert J. Oberleitner

*Assistant Examiner*—C. T. Bartz

*Attorney, Agent, or Firm*—Edgar W. Averill, Jr.

[57] ABSTRACT

A truck assembly for skateboards where the axle assembly is supported on an elastomeric bumper which in turn is supported on an angled shaft. As the skateboard is tilted, the bumper is twisted, causing the axle of the skate assembly to tilt and turn. The bumper is held at one end to the base and at the other end to the axle assembly.

6 Claims, 3 Drawing Sheets

TRUCK ASSEMBLY FOR SKATEBOARDS

BACKGROUND OF THE INVENTION

The typical truck assembly which has been used for roller skates and skateboards has an axle which is supported at two places. One of these places is a pivot fixture and the other is a kingpin fixture where the support ring is held between two cushions on an angled kingpin. This support system is somewhat limited as to turning ability and, in order to make a really tight turn, it is necessary to loosen the kingpin. The support is also quite limited in any flexibility in the event a bump is hit.

BRIEF SUMMARY OF THE INVENTION

It is an object of the present invention to provide a truck assembly which permits tight turns and also provides substantial spring or shock absorbing action.

The present invention is for a truck assembly for skateboards which is supported on a base which is attached to the underside of a skateboard. An axle assembly support shaft is held at an angle to the base. The base holds a bumper base end support member which surrounds the axle assembly support shaft. A bumper base end passageway support stub also surrounds the axle assembly support shaft. A bumper assembly has a base surface, an elastomeric bumper body extending away from said surface to an axle surface. The base surface of the bumper assembly abuts the bumper base end support member in a non-turning manner. The bumper assembly has a central passageway which surrounds the bumper base and passageway support stub at a base end thereof. A bumper axle end passageway support stub surrounds the axle assembly support shaft and is surrounded by the central passageway of the bumper assembly. A bumper axle end support member surrounds the axle assembly support shaft and is moveable through an arc with respect to the axle assembly support shaft and positioned against said axle surface of the bumper assembly in a non-turning member with respect to the axle surface. Means are provided for holding the bumper axle end support member on an outer end of the axle assembly support shaft which means permits the upper axle and support member to be moved through an arc with respect to the support shaft. A wheel axle is held in a fixed manner with respect to the bumper axle and support member. The wheel axle has a right end and left end to which wheels are affixed in a conventional manner. When the truck assembly is affixed to a skateboard and when one side of the skateboard is depressed, the wheel axle will move through an arc about the support shaft central axis and the wheels affixed to the axle will be turned away from the vertical longitudinal central axis of the skateboard, thereby causing the skateboard to turn. The bumper preferably has a Shore A hardness of between 70 and 85 and preferably has a steel washer affixed to its base surface and to its axle surface. Preferably, the bumper base end passageway support stub and the bumper axle end passageway support stubs are interlocked to limit the turning of the wheel axle on the axle assembly support shaft.

DESCRIPTION OF THE PREFERRED EMBODIMENTS

Figure 1:
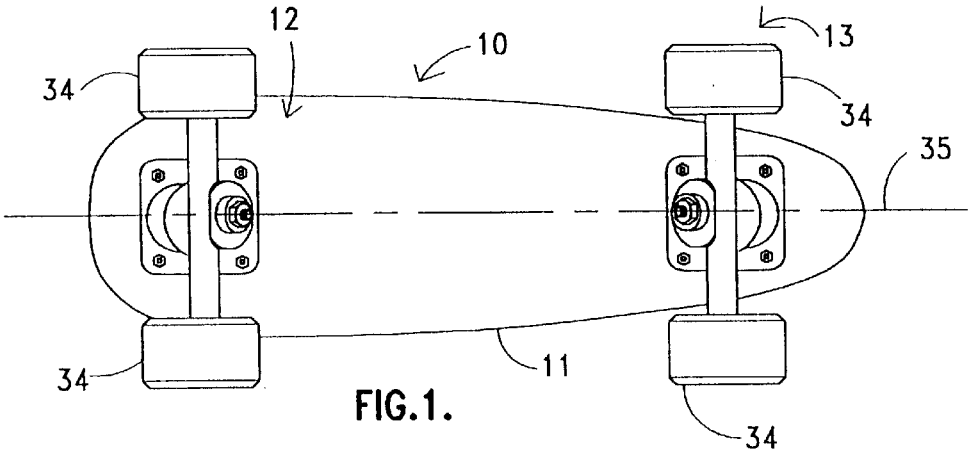
FIG. 1 is a bottom view of a skateboard including a pair of truck assemblies of the present invention.
Figure 4:
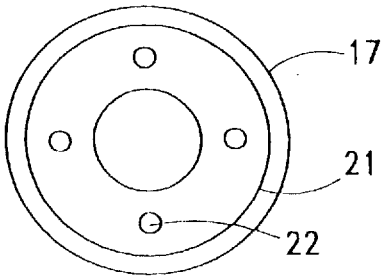
FIG. 4 is a top view of the bumper assembly of the truck assembly of FIG. 2.

The skateboard assembly of the present invention is shown in bottom view in FIG. 1 and indicated generally by reference character 10. Skateboard assembly 10 has a skateboard 11 which is conventional and which on its underside supports a pair of wheel and truck assemblies 12 and 13. The rear wheel and truck assembly 12 is shown in side view in FIG. 2 where the base 14 thereof is securely affixed to the underside of board 11 and supports an upper base and support member 15. A bumper assembly 16 is held against the bumper base and support member 15 in a non-turning manner. Bumper assembly 16 includes an elastomeric bumper 17 which has a base surface 18 which includes a base washer 19 which is securely bonded to the elastomeric bumper 17. The axle surface 20 of bumper assembly 16 includes an axle washer 21. As shown in FIG. 4, axle washer 21 has four holes 22. One of these holes surrounds axle washer pin 23 so that the axle surface 20 of bumper assembly 16 will always move with the axle washer pin 23 and the assembly to which it is affixed.

Axle washer pin 23 is supported by bumper axle and support member 24. Member 24 also holds a bumper axle and passageway support stub 25. Bumper axle and passageway support stub 25 is positioned within passageway 26 of bumper assembly 16. Similarly, a bumper base and support member 15 holds base washer pin 27 which fits within one of the base washer holes 28 of base washer 19 of axle assembly 16. A bumper base and passageway support stub 29 is supported by bumper base and support member 15 and fits within passageway 26 of bumper assembly 16.

Figure 2:
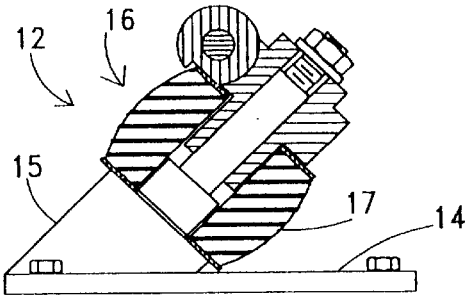
FIG. 2 is a side view of one of the truck assemblies of FIG. 1 partly in cross-section.
Figure 5:
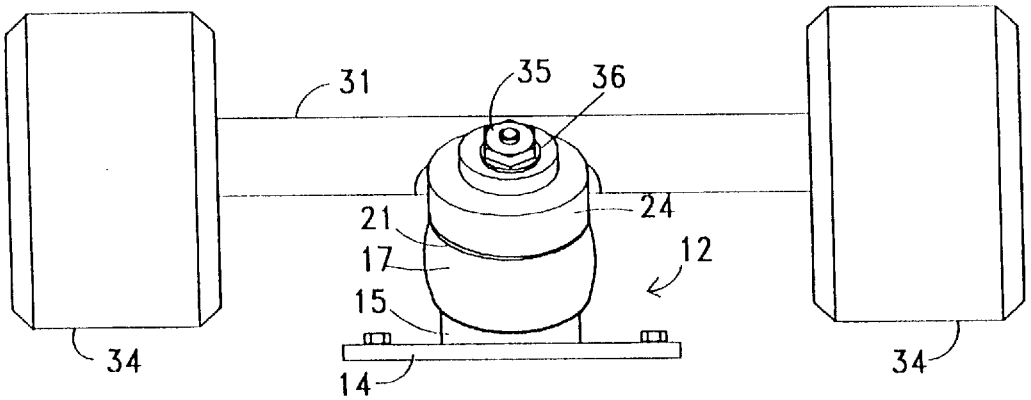
FIG. 5 is a rear view of one of the truck assemblies of the skateboard assembly of FIG. 1.
Figure 6:
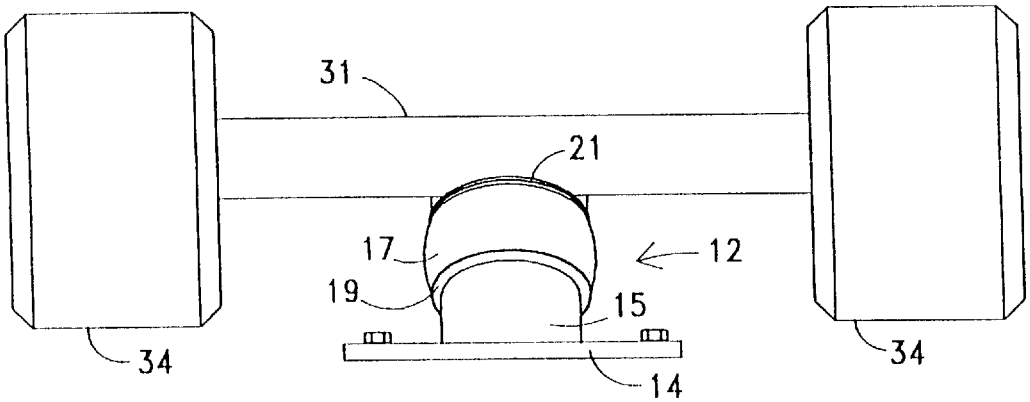
FIG. 6 is a front view of the truck assembly of FIG. 5.
Figure 7:
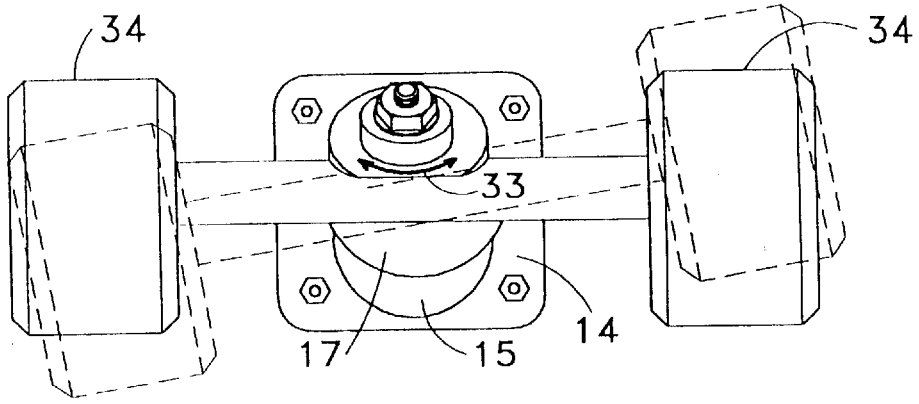
FIG. 7 is a bottom view of one of the truck assemblies of the skateboard assembly of FIG. 1 showing the turning arc of the axle and wheels thereof.

Thus, as the rear wheel and truck assembly 12 is assembled as shown in FIG. 2 and the axle 30 is turned with respect to base 14, the axle washer 21 will move with axle 30 and the base washer 19 will be securely supported with respect to base 14, thereby twisting the elastomeric bumper 17. The axle is securely held in a manner which permits it to turn in an arc to axle assembly support shaft 32. This arc is indicated by arrow 33 in FIG. 7. As it turns by the depressing of one of the sides of board 11, about its vertical longitudinal central axial plane 35, the wheels 34 change direction as indicated by the hidden line in FIG. 7. The view of the truck assembly of the present invention from the rear of skateboard assembly is shown in FIG. 5. This same assembly is shown from the opposite or front side of the rear wheel and truck assembly 12 in FIG. 6.

The bumper axle and support member 24, and thus axle 30, is held to base 14 by nut 36 which abuts washer 37. Nut 36 is threaded onto the threaded portion 38 at the end of axle assembly support shaft 32.

Figure 3:
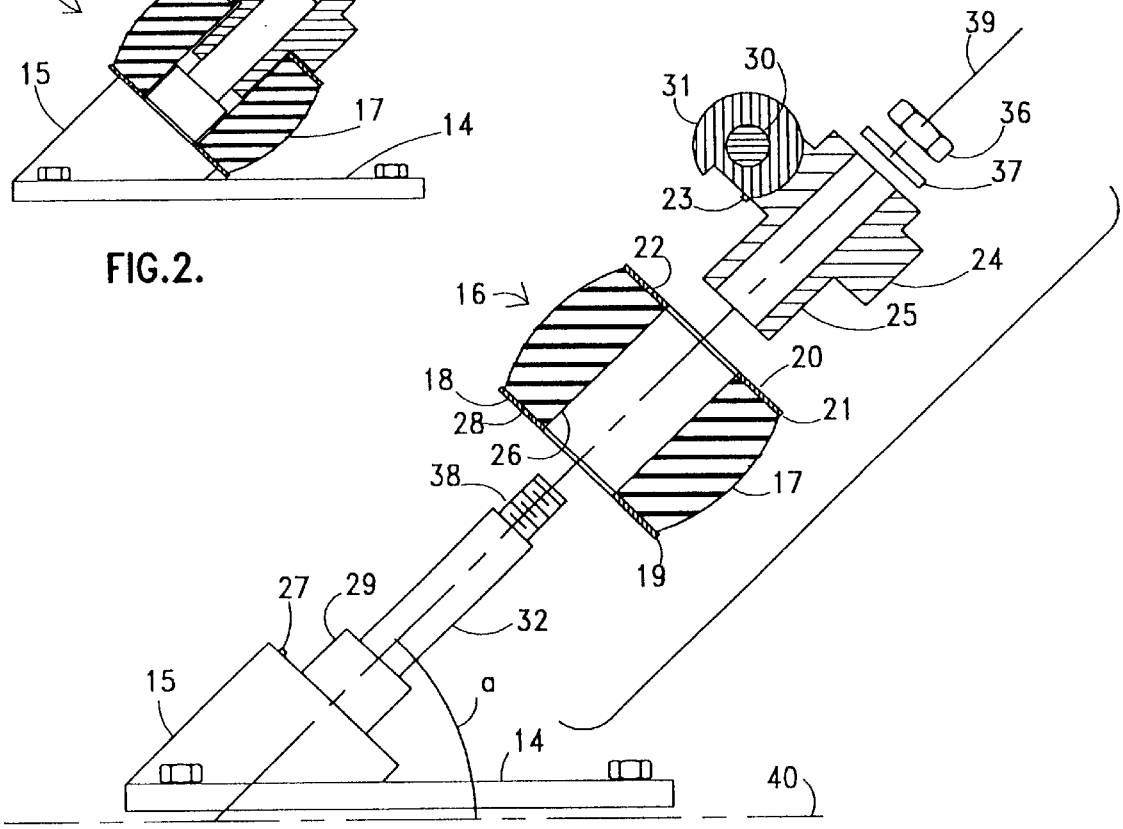
FIG. 3 is an exploded side view partly in cross-section of the truck assembly of FIG. 2.

Axle assembly support shaft 32 has a central axis 39 which is supported at an angle "a" with respect to horizontal attachment plane 40 shown in FIG. 3. This angle is preferably between 30 and 75 degrees with a preferred angle being about 45 degrees. The larger angle "a" is, the more axle 30 will turn as the board 11 is tilted.

The elastomeric bumper 17 should be fabricated from an elastomeric that has a Shore A hardness of between 70 and 85. The elastomer should be sufficiently strong so that it will not tear during the twisting thereof and it has been found that a urethane polymer works well for this purpose. Urethane polymer also permits the secure bonding of base washer 19 and axle washer 21 to the ends thereof. The size of the elastomeric bumper 17 depends on the size of the skateboard to which it is affixed. For large motorized skateboards an outside diameter of about 2" has been found appropriate whereas for more conventional skateboards, an outside diameter of 1½" is satisfactory. The elastomer should also have a certain deadening effect and a rebound value of about 50 is believed ideal, although higher rebound values can be used to provide more bounce. An important advantage of the present assembly is the cushioning action provided by the compression of elastomeric bumper 17 when the skateboard goes over a bump. The amount of compression should be up to about 0.25".

Figure 8:
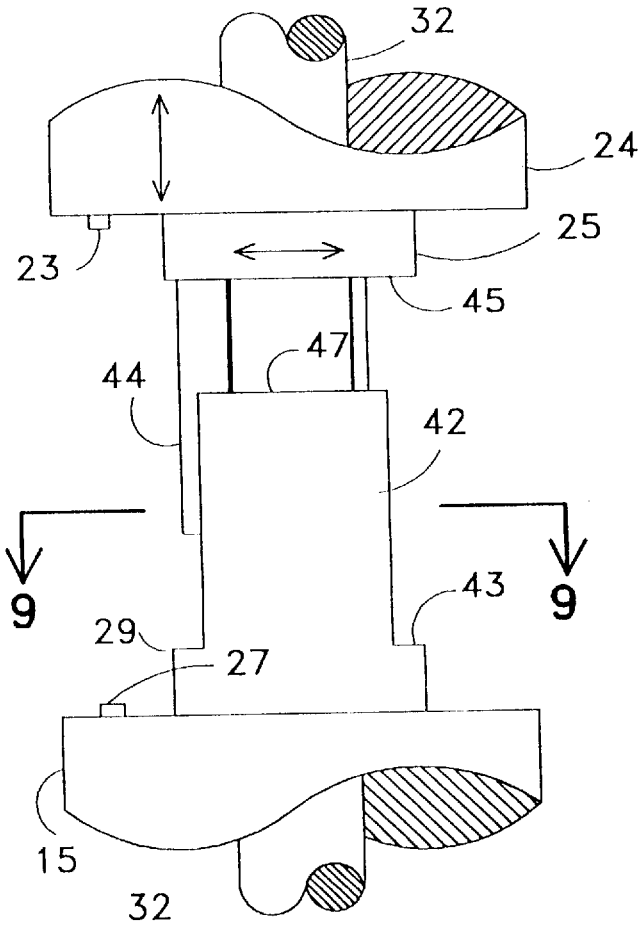
FIG. 8 is an enlarged front view of the bumper base and axle end passageway support stubs, including an interlocking feature.
Figure 9:
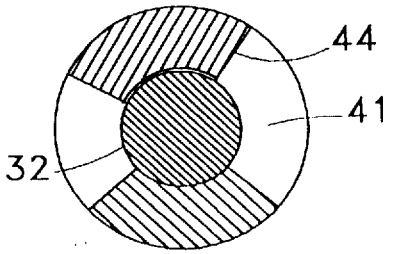
FIG. 9 is a cross-sectional view taken along line 9—9 of FIG. 8.

It has been found desirable to limit the amount of turning between the axle and the base. One method of doing this is shown in FIG. 8 where a notch 41 is formed around a lower finger 42 of bumper base and passageway support stub 29. Notch 41 has a notch base 43. An upper finger 44 is positioned within notch 41 and has an upper base 45. Thus, upper finger 44 will abut lower finger 42 as the axle is turned to its maximum permitted amount. Note that the upper finger 44 has a tip 46 which is separated from notch base 43 a distance which limits the compression of elastomeric bumper 17. Similarly, lower finger 42 has a tip 47 which is separated from upper base 45 the same distance as tip 46 is notch base 43. Preferably the amount of turning is about 45 degrees.

The result is a truck assembly which has a very secure support with no slop which is common with the prior art truck assemblies. The feel of the truck assembly can be greatly changed by the hardness and rebound characteristics of the elastomeric bumper. Also, nut 36 can be tightened to limit the maximum amount of compression of bumper 17.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A truck assembly for skateboards comprising:

a base having means for attachment to an underside of a skateboard, said means for attachment including a horizontal attachment plane parallel to an underside of a skateboard, said base having a vertical, longitudinal, central axial plane extending through a center of said base which vertical, longitudinal, central axial plane will be aligned with a central axis of a skateboard when mounted to a skateboard;

an axle assembly support shaft supported by said base, said axle assembly support shaft having a support shaft central axis positioned at an angle of between 30 degrees and 75 degrees with respect to said horizontal attachment plane and within said vertical, longitudinal, central axial plane;

a bumper base end support member affixed to said base and surrounding said axle assembly support shaft in a fixed, non-turning manner with respect to said base;

a bumper base end passageway support stub surrounding said axle assembly support shaft;

a bumper assembly having a base surface, an elastomeric bumper body extending away from said base surface to an axle surface, said base surface abutting said bumper base end support member in a non-turning manner, a central passageway through said elastomeric bumper body;

a bumper axle end passageway support stub surrounding said axle assembly support shaft and surrounded by said central passageway of said elastomeric bumper body and said axle surface;

a bumper axle end support member surrounding said axle assembly support shaft and movable through an arc with respect to said axle assembly support shaft and positioned against said axle surface of said bumper assembly in a non-turning manner with respect to said axle surface;

means for holding said bumper axle end support member on an outer end of said axle assembly support shaft which permits said bumper axle end support member to be moved through an arc with respect to said support shaft; and a wheel axle held in a fixed manner with respect to said bumper axle end support member, said wheel axle having a right end and a left end whereby when said truck assembly is affixed to a skateboard and when one side of the skateboard is depressed, the wheel axis will move through an arc about the support shaft central axis and wheels affixed to the axis will be turned away from a vertical, longitudinal, central axis of the skateboard thereby causing the skateboard to turn.

2. A truck assembly (12) for skateboards comprising:

a base (14) having a skateboard attachment surface;

an axle assembly support shaft (32) held by said base (14) at an angle of between 30 and 75 degrees with respect to said skateboard attachment surface;

a flexible bumper assembly (16) including a bumper portion (17) fabricated from an elastic material, said flexible bumper assembly (16) surrounding said axle assembly support shaft (32), said flexible bumper assembly (16) having a base end (19) abutting said base (14) and an axle end (20);

means for connecting said base end (18) and said base (14) so that said base end (18) does not turn with respect to said base (14) and said means for connecting said base end does not significantly interfere with torsional twisting of said bumper portion (17); and a bumper axle end support member (24) held by said axle assembly support shaft (32), said bumper axle end support member (24) having means for connecting said axle end (20) to said bumper axle end support member (24) so that they do not turn with respect to each other and wherein said means for connecting said axle end (20) does not significantly interfere with torsional twisting of said bumper portion and said bumper axle end support member (23) further including means (31) for supporting a wheel supporting axle (30);

wherein said means for connecting said base end (18) and said base comprise bonding said base end (18) to a rigid base end plate (19) and wherein said bumper axle end support member has means (27,28) for connecting with said rigid base plate end plate (19) and said base so that the base end plate (19) does not turn with respect to said base (14).

3. The truck assembly (12) for skateboards of claim 2 wherein said means for connecting said axle end (20) to said bumper axle end support member (24) comprises a rigid axle end plate (21) bonded to said axle end (20) of said flexible bumper assembly (16) and said bumper axle end support member (24) having means (22, 23) for connecting said rigid axle end plate (21) with said bumper axle end support member (24) so that they do not turn with respect to each other.

4. The truck assembly for skateboards of claim 3 wherein said rigid base end support plate and said rigid axle end support plates are bonded to said bumper portion along a flat surface.

5. The truck assembly for skateboards of claim 4 wherein said rigid base end support plate and said rigid axle end support plates are parallel.

6. A truck assembly (12) for skateboards comprising:

a base (14) having a skateboard attachment surface;

an axle assembly support shaft (32) held between said base (14) and an axle holding member (24) at an angle of between 30 and 75 degrees with respect to said skateboard attachment surface;

a flexible bumper assembly (16) including a bumper portion (17) fabricated from an elastic material, said flexible bumper assembly (16) surrounding said axle assembly support shaft (32), said flexible bumper assembly (16) having a base end (18) abutting said base (14) and an axle end (20);

means for connecting said base end (18) and said base (14) so that said base end (18) does not turn with respect to said base (14);

an axle holding member (24) held by said axle assembly support shaft (32), said axle holding member (24) having means for connecting said axle end (20) to said axle holding member (24) so that they do not turn with respect to each other and said axle holding member (24) further including means (31) for supporting a wheel supporting axle (30); and said axle holding member further including a finger (44) positioned around a portion of said axle assembly support shaft (32) and said base having a notch (41) in which said finger (44) can turn in a limited arc and the amount of the limited arc is defined by edges (42) of said notch (41) whereby the turning of the axle holding member about the axle assembly support shaft is limited in both directions by contact between the finger (44) and the edges (42) of the notch (41).

* * * * *